United States Patent [19]

Riehm et al.

[11] 4,168,988

[45] Sep. 25, 1979

[54] PROCESS FOR THE WINNING OF XYLOSE BY HYDROLYSIS OF RESIDUES OF ANNUALS

[75] Inventors: Theodor Riehm, Mannheim, Fed. Rep. of Germany; Gerrit Hofenk, Veenendaal, Netherlands

[73] Assignee: Institut voor Bewaring en Verwerking van Landbouwprodukten, Wageningen, Netherlands

[21] Appl. No.: 905,984

[22] Filed: May 15, 1978

[30] Foreign Application Priority Data

May 17, 1977 [GB] United Kingdom ..... 20767/77

[51] Int. Cl.[2] ..... C13K 13/00; C13K 1/04

[52] U.S. Cl. ..... 127/37

[58] Field of Search ..... 127/37, 1; 162/91, 97

[56] References Cited

U.S. PATENT DOCUMENTS

| | | | |
|---|---|---|---|
| 2,734,836 | 2/1956 | Elian | 127/37 |
| 2,778,751 | 1/1957 | Riehm | 127/37 |
| 2,900,284 | 8/1959 | Oshima | 127/37 |
| 3,523,911 | 8/1970 | Funk | 127/37 X |
| 3,787,241 | 1/1974 | Eickemeyer | 127/37 X |
| 3,928,121 | 12/1975 | Zepeda-Castillo | 127/37 X |
| 4,023,982 | 5/1977 | Knauth | 127/37 X |
| 4,070,232 | 1/1978 | Funk | 127/37 X |

*Primary Examiner*—Sidney Marantz

*Attorney, Agent, or Firm*—Hopgood, Calimafde, Kalil, Blaustein & Lieberman

[57] ABSTRACT

Xylose is produced from residues of annuals by (a) extracting soluble and solubilizable undesired substances from the residues countercurrently with an aqueous acid solution, (b) pressing the extracted residues to remove as much as possible of the proportion of undesired substances, (c) moistening the pressed residues with an acid solution which contains xylose; (d) hydrolyzing the pentosans present in the residues by increasing the temperature of the acidified moistened residues, (e) terminating the hydrolysis by decreasing the temperature of the hydrolyzed residues, (f) extracting the pentoses from the hydrolyzed residues with water, (g) purifying and concentrating the xylose solution obtained, and, if desired, (h) winning xylose by crystallization.

11 Claims, 1 Drawing Figure

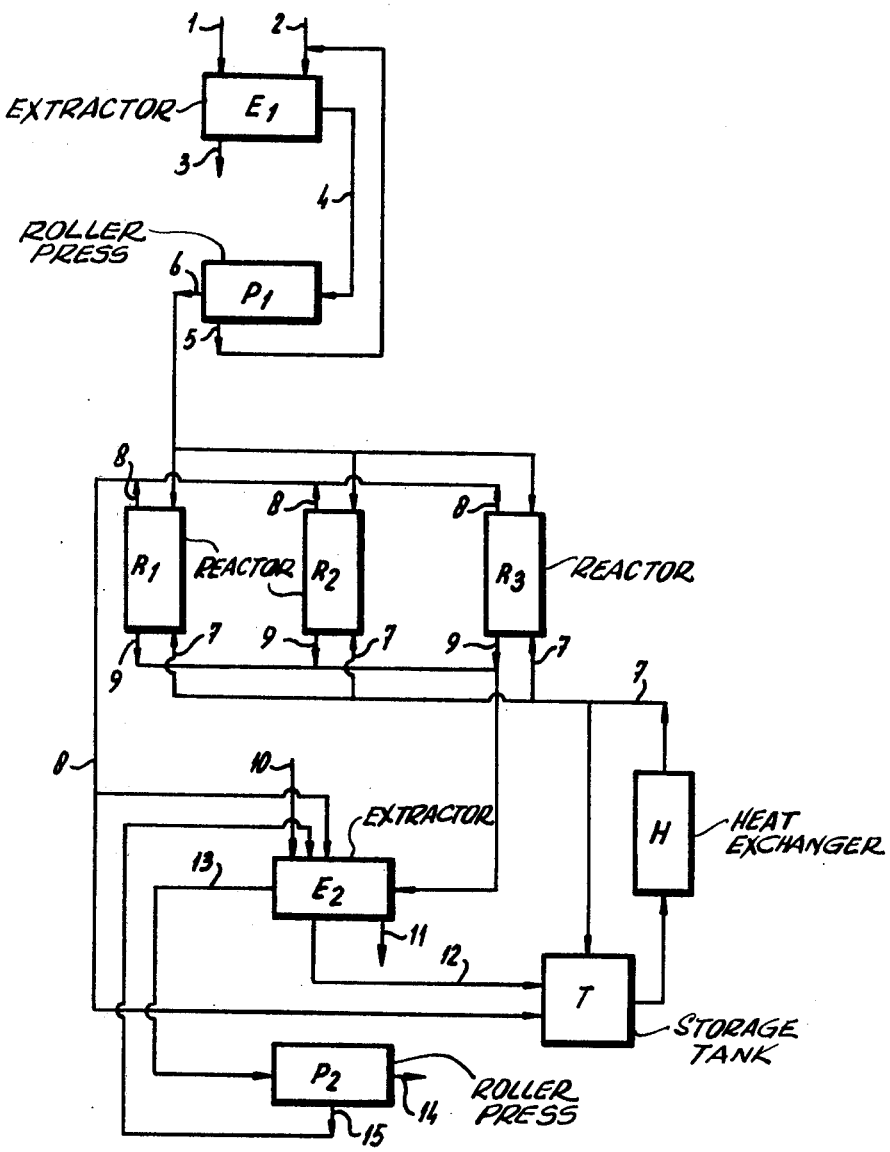
EXTRACTOR
E1
ROLLER PRESS
P1
REACTOR
R1
R2
R3
REACTOR
EXTRACTOR
E2
H
HEAT EXCHANGER
T
STORAGE TANK
P2
ROLLER PRESS

PROCESS FOR THE WINNING OF XYLOSE BY HYDROLYSIS OF RESIDUES OF ANNUALS

BACKGROUND OF THE INVENTION

The invention relates to a process for the winning of xylose by the hydrolysis of residues of annuals with acid solutions.

In the past several attempts have been made to obtain relatively pure xylose solutions so as to easily win pure xylose by crystallization.

Japanese Patent Application No. 55856/72 describes a process for the preparation of xylose from agricultural waste materials by hydrolysis with dilute sulfurous acid. The waste materials are first pre-washed with hot water or diluted acid. Then the pre-washed materials are hydrolyzed with a 0.05 to 2.0% aqueous solution of sulfur dioxide at a temperature of 130 to 170° C. by which the xylans are converted to xylose. After concentration of the hydrolysate xylose is obtained by crystallization. The agricultural waste materials to be treated contain at least 20% by weight of xylans. By the pre-washing step with hot water or diluted acid the waste materials are subjected to 6 to 15% of weight loss on the basis of the dry substance. In the example pre-washing is carried out with water at 140° C. for 90 minutes. Hydrolysis is carried out with 0.2% solution of sulfur dioxide at 160° C. for 20 minutes, the pH of the mixture being 1.5. Xylose is won from the hydrolyzate in a manner known per se. Pre-washing with diluted acid is not illustrated. A critical discussion and a detailed description of the pre-washing step is lacking.

According to laid-open Dutch Patent Application No. 70,01592 the presence of impurities inhibiting the crystallization is substantially avoided by hydrolyzing comminuted shells of stone-fruits with mineral acids at an elevated temperature. This raw material is, however, not readily available in large quantities.

According to laid-open Dutch Patent Application No. 69,10072 vegetable materials such as grasses and wood are hydrolyzed with a diluted aqueous solution of oxalic acid at elevated temperatures. Preferably, the raw material is washed with boiling water before hydrolysis to remove free sugars, particularly glucose and galactose, and tanning and colouring substances. Since oxalic acid is expensive this known method is not economical.

French Patent Specification No. 1,477,305 describes the preparation of xylose and cellulose from vegetable materials containing cellulose by treating them with diluted mineral acids such as sulfuric acid, sulfurous acid or hydrochloric acid. The hydrolysis may be carried out either continuously or batchwise. This process yields a xylose solution which is heavily contaminated with organics and salts.

According to British Patent Specification No. 934,904 residues of tannin extraction and of sugar extraction are used as the raw material for the hydrolysis to xylose.

German Auslegeschrift No. 2,538,407 discloses washing with an aqueous solution of alkali before hydrolysis to remove acetic acid from the raw material. Since the hydrolysis is carried out with acids, washing with alkali necessitates washing with water and neutralization to remove alkali and salts before the hydrolysis is carried out.

SUMMARY OF THE INVENTION

It has now been found how the drawbacks of the known processes can be avoided and at the same time optimum yields of a pure xylose can be obtained in an economical manner.

According to the present invention there is provided a process for the winning of xylose by the hydrolysis of residues of annuals with acid solutions which process comprises the steps of (1) solubilizing, dissolving, and extracting salts and undesired organic substances from the residues of annuals by contacting them countercurrently with an aqueous acid solution at an elevated temperature during such a time that $$^{10}\log t_1 = pH_1 - (T_1/25) + f_1 \quad \text{(I)}$$

wherein $t_1$ is the acting time of the acid solution in minutes, $pH_1$ is the value of the pH of the aqueous acid solution used for this treatment of the residues of annuals, which value should range from 1 to 5, $T_1$ is the holding temperature of the mixture of residues of annuals and acid solution in ° C., $f_1$ is an number having a value of from 2.5 to 4.0 dependent on the type and nature of the residues of annuals used and on the mechanical treatment during this step, as well as on the particle size of the residues of annuals used;

(2) pressing the treated residues;

(3) moistening the pressed residues to a moisture content of at least 75% by weight of the moist residues with an acid solution which contains xylose and which does not contain $SO_2$, either (a) when the hydrolysis is carried out continuously by simultaneously feeding the acid solution and the pressed residues to the hydrolysis reactor, or (b) when the hydrolysis is carried out discontinuously in a vertical column by slowly introducing the acid solution at the bottom of the column;

(4) hydrolyzing the pentosans present in the acidified residues either (a) in a continuously operated apparatus by blowing steam into the acidified residues, or (b) in a discontinuously operated apparatus by heating the acid solution of step (3b), and maintaining the conditions during such a time that $$^{10}\log t_2 = pH_2 - (T_2/25) + f_2 \quad \text{(II)}$$

wherein $t_2$ is the hydrolysis time in minutes, $pH_2$ is the value of the pH of the liquid present in the mixture of residues and acid solution, which value should be lower than 3.0, $T_2$ is the holding temperature of said mixture in ° C., which should be higher than 100° C., $f_2$ is a number having a value of from 5.4 to 6.2;

(5) terminating the hydrolysis by decreasing the temperature either by quenching or by releasing the pressure from the reactor;

(6) extracting the pentoses from the residues with water either (a) continuously and countercurrently, or (b) discontinuously in a column in a downward flow;

(7) filtering the xylose solution obtained, decolourizing and purifying it with a cation- and an anion-exchange resin, concentrating it by evaporation, and winning xylose from the xylose syrup obtained by crystallization and isolation of the crystalline mass. For several purposes it is also possible to use the xylose syrup as such or after hydrogenation.

The raw materials used for the process according to the invention are residues of annuals, e.g. maize plant residues, esparto grass, reed, and particularly cereal straw such as wheat straw.

Before subjecting it to the process of the invention the raw material may be comminuted, e.g. by chopping. Though xylose is initially obtained as a solution which is filtered and purified before crystallization, it is desirable to remove solid impurities such as dust, dirt, sand and metal particles already from the raw material so as to prevent abrasion and damage of the apparatuses.

The first step of the process is continuously and countercurrently solubilizing, dissolving, and extracting salts and undesired organic substances from the residues of annuals used as the raw material. Such residues contain soluble or solubilizable substances such as monomeric and oligomeric sugars, e.g. arabinose and mannose, tanning substances colouring substances, salts, acetic acid and other organic acids, all in varying amounts dependent on the conditions under which the annuals have been growing. In order to obtain a xylose syrup of sufficient purity to be used as such or from which syrup xylose can be crystallized in a sufficient yield and of sufficient purity, it is necessary to remove such soluble or solubilizable impurities. Moreover, by removing the salts in this early stage of the process an undue loading of the cation-exchange resin used for the purification of the final xylose solution is avoided. An other advantage is that the slowly dissolving alkaline salts of Ca and Mg are dissolved and neutralized for a major part so that only small amounts of acids are consumed in the subsequent hydrolysis. The hydrolysis rate is dependent on the amount of free acid and it is, of course, desirable to avoid a varying amount of free acid during the hydrolysis.

This extraction with an acid solution as the first step of the process has several advantages over pre-washing with water. By pre-washing with water a considerable proportion of the easily water-soluble salts and several water-soluble organic substances are removed. The slowly or difficultly dissolving salts and certain organic substances are not or only partially removed.

Due to the countercurrent extraction with acid solution it is possible to have sufficient acid in the residues for the hydrolysis step.

By the acid extraction step the following additional advantages are obtained:

A. As to the salts and cations:

(1) the water-soluble and alkaline salts are neutralized and can no more decrease the acidity of the reaction mixture in the hydrolysis step, which benefits the controlling of the process;

(2) the partially alkaline, organic and inorganic salts which dissolve slowly or which are difficultly soluble are solubilized, dissolved and, where possible neutralized (e.g. calcium and magnesium salts of sulfuric acid, phosphoric acid and certain organic acids);

(3) the calcium and magnesium ions bonded to acid groups present in the tissue of the residues of annuals are replaced with hydrogen ions and go into solution. Such acid groups are derived from, i.e., the uronic acids (in the pectins). Other acid groups are the phenolic moieties and the carboxyl groups in the lignin.

B. As to the organic substances:

(1) part of the non-xylose isomers such as arabinose which are said to be bonded to or to be present as side-chains in the hemicellulose are solubilized or hydrolyzed by the acid and are dissolved. Under the extraction conditions indicated in formula (I) a considerable proportion of the arabinose may be removed at the cost of only a slight loss of xylose because there is a big difference between the hydrolysis rate constants of splitting off arabinose and of hydrolysis to yield xylose;

(2) the acid will also hydrolyze and dissolve a considerable proportion of other, lower polymeric and easily hydrolyzable sugars and related carbohydrates. By this reaction products such as fructosans, pectins and mucous components are removed and go into solution as, i.a., fructose, arabinose, mannose, glucose, and uronic acids.

The removal to a great extent of salts, ions and several organic substances, i.e. isomers of xylose, with the aid of acid offers big advantages:

(1) in that the ion-exchange resins necessary for the further purification of the crude xylose solution are loaded to a smaller extent due to which a lower capacity of the ion-exchange resins is required and regeneration costs are reduced;

(2) in that a decrease of the content of isomeric sugars and other organic impurities benefit the efficiency of the crystallization of xylose from the final crude xylose solution. Such impurities slow down the crystallization rate, decrease the yield of crystalline product and necessitate an additional recrystallization step.

Since step (1) is carried out with an acid solution not only the undesirable substances soluble in diluted acid are extracted, but also a beginning hydrolysis of pentosans occurs. So an optimum must be found whereby a considerable proportion of the impurities including non-xylose sugars and the lowest possible proportion of xylose is extracted.

This is attained by adjusting the parameters $t_1$, $pH_1$, $T_1$ end $f_1$ in mutual relationship as indicated in the aforementioned equation (I). $pH_1$ is the value of the pH of the liquid used for this treatment of the residues of annuals.

As mentioned before $f_1$ is a term the value of which may vary from 2.5 to 4.0 depending on the type and nature of the residues of annuals used and on the mechanical treatment during the extraction (e.g. stirring). This value is also dependent on the particle size of the residues of annuals. If for a certain material the value of $f_1$ is lower than the lower limit of the specific range the salts and other impurities will be insufficiently removed. If the value of $f_1$ is higher than the upper limit of the specific range too much xylose will be lost by a premature hydrolysis of pentosans.

The acids used in the aqueous acid solution may be mineral acids other than sulfurous acid such as hydrochloric or sulfuric acid, and aliphatic carboxylic acids having 1 to 3 carbon atoms in the molecule, such as formic acid, acetic acid and propionic acid, or aliphatic hydroxycarboxylic acids having 2 to 6 carbon atoms in the molecule, such as glycolic acid, lactic acid, hydroxybutyric acid, hydroxyvaleric acid and hydroxycaproic acid. Suitably, a 0.1 to 0.4% solution of hydrochloric acid is used in this step of the process. Alternatively, a 0.25 to 1.0% solution of sulfuric acid is used. Since sulfuric acid is less corrosive than hydrochloric acid it is preferably used in a continuous process. The acid solution may have a temperature of from about 50 to about 100° C., preferably from 60 to 80° C.

This acid extraction step (1) of the process may be carried out in any extraction apparatus wherein the acid solution can be passed countercurrently and continuously through the residues.

Suitable, a salt-free aqueous liquid is used which is obtained by condensing the water vapour produced by concentrating the final xylose solution to which is added the required amount of acid. Since acetic acid is hardly bonded by the anion-exchange resin used for this purification of the xylose solution, the water vapour produced by concentrating the xylose solution also will contain acetic acid. As a result the condensate of the water vapour will contain acetic acid. The solution obtained by this extraction may be used for the production of methane by an anaerobic fermentation and the methane may be used as fuel gas. Alternatively it may be used as a substrate for the production of biomass, single cell protein or enzymes.

In the extraction step (1) and the pressing step (2) the dissolved salts and organic substances are removed which otherwise would have to be removed by the ion-exchange resins employed in step (7) for purifying the xylose solution. By the removal of those impurities in steps (1) and (2) the load of the ion-exchange resins is reduced to about 10 to 20% of the load obtained when the impurities would not be removed in steps (1) and (2).

A suitable embodiment of the extraction step (1) comprises the use of a screw extractor or any other continuously working extraction apparatus. A preferably used extractor is the DDS-screw extractor.

In order to produce a xylose solution having a concentration as high as possible water must be removed from the residues of annuals in step (2). By pressing, preferably between squeeze rolls, water is removed to yield a mass wherein the proportion of free water has been considerably reduced, viz. to about 55–65% by weight of the pressed material. Of course, because the residues have been soaked in aqueous liquids they retain also a considerable proportion of water absorbed in the vegetable tissue.

Before the hydrolysis step the residues must be moistened with an aqueous liquid which contains pentoses and to which is added a certain amount of acid to obtain the concentration of acid required for the hydrolysis.

It has been found that the velocity of the hydrolysis reaction is also dependent on the water content of the reaction mixture. However, the rate of decomposition of dissolved xylose is not affected by this water content. To enable the extraction of a solution having a sufficiently high concentration of xylose from the residues it is necessary to moisten with an aqueous liquid which contains xylose. This aqueous liquid is taken from a suitable place in the extraction step (6). The proportion of the aqueous liquid used for moistening the pressed residues should not be chosen too high to avoid that too large a quantity of xylose is circulated in the process. As mentioned before the moisture content of the hydrolysis mixture should be at least 75% by weight and no more than 90% by weight.

The hydrolysis step (4) may be carried out either continuously or discontinuously. The continuous hydrolysis may be carried out in a Kamyr apparatus as used for digestion of the raw material in paper-making. The solution for the moistening step (3) is fed to the top of the apparatus. Preferably, the discontinuous hydrolysis is carried out in a column.

Part of the water in the pressed residues can be displaced with an aqueous acid solution which contains pentoses. This solution is fed to the bottom of the column and displaces the water still present in the residues. Part of the water absorbed in the residues is withdrawn by diffusion and osmosis. About half of the amount of water originally present in the residues is displaced as a layer of a diluted solution of acid and pentoses floating on the column of acid solution which gradually fills the free volume of the mass of residues and is drawn off at the top of the column. The acid solution employed in this step is an appropriate fraction taken from the washwater used for washing the residues after the hydrolysis. Since acid is consumed in the process it is necessary to increase the concentration of the acid in the filtrate by supplying fresh acid.

This solution containing pentoses and acid is passed through a heat exchanger to bring it at the temperature at which the hydrolysis will be carried out. This heated solution is fed to the bottom of the hydrolysis column until the temperature at the top of the column is the same as the temperature at the bottom of the column. In this way the residues are heated without blowing steam in the reaction mixture which would cause dilution of the hydrolysate.

Due to the presence of xylose in this solution the amount of water to be evaporated in the final step of the isolation of xylose is reduced.

The acid used for the acidification of the residues before hydrolysis may be a mineral acid such as hydrochloric, sulfuric, phosphoric acid, with the exception or sulfurous acid, or an organic acid such as tartaric, citric, gluconic acid.

A suitable acidifying solution may contain 0.1 to 0.4% by weight of hydrogen chloride and 2 to 3% by weight of xylose, based on the solution.

The temperature of the acidifying solution should range from about 100° to about 140° C.

Subsequently, the moist acidified residues are hydrolyzed in step (4) by maintaining the temperature. Here again the parameters $t_2$, $pH_2$, $T_2$ and $f_2$ should be adjusted in mutual relationship as indicated in the aforementioned equation (II) so as to obtain optimum results, i.e. the highest possible yield of xylose by hydrolysis of the pentosans, the lowest possible degradation of xylose and the lowest possible formation of decomposition products and other undesired derivatives of pentoses. Preferably the hydrolysis temperature is about 120° C. Since the temperature may be above 100° C. it will be understood that the hydrolysis is carried out under pressure in a closed vessel. If the reaction conditions are adjusted as indicated in equation (II) the pentosans present in the residues of annuals are hydrolyzed to such an extend that the highest possible yield of xylose is obtained, i.e. they are saccharified to xylose and minor amounts of other pentoses such as arabinose. As mentioned before $f_2$ is a term varying from 5.4 to 6.2. If $f_2$ is lower than 5.4 the hydrolysis of pentosans and consequently the formation of xylose is unduly low. If $f_2$ is higher than 6.2 the residual proportion of unconverted pentosans is low, but the proportion of degraded xylose is unacceptably high. In other words, the optimum value of $f_2$ within the limits indicated is dependent on the rate of the formation of xylose from pentosans and the rate of conversion or degradation of the xylose formed, which rates may be characterized by the respective reaction constants k.

A further measure for preventing undue degradation of xylose formed is to continue feeding the afore-mentioned hot solution containing 2 to 3% by weight of xylose to remove newly formed xylose from the reaction mixture. In this way the concentration of xylose in the reactor is kept as low as possible.

During hydrolysis the residues shrink to about 50% of the original volume and at the end of the hydrolysis the column will contain a large amount of free supernatant liquid. Suitably, the formation of supernatant liquid is avoided by drawing it off continuously during the hydrolysis.

After the hydrolysis the following step (5) comprises decreasing the temperature of the hydrolyzed residues. In a continuous hydrolysis the hydrolyzed residues are blown off into a tank kept at atmospheric pressure. In a discontinuous hydrolysis the temperature is first decreased by releasing the pressure from the reactor to prevent the formation of degradation and conversion products of sugars under the influence of the acid present in the reaction mixture.

The xylose formed by the hydrolysis has to be extracted from the residues. This can be done either countercurrently in a continuously working extractor such as a DDS screw extractor or in a column by feeding water to the top and withdrawing a xylose solution from the bottom.

The crude xylose solution thus obtained contains xylose but also oligomers of xylose. It is necessary to subject this solution first to a heat treatment in the presence of an acid in order to depolymerize these oligomers of xylose. For this purpose the crude acid xylose solution is heated during a certain time in order to achieve this depolymerization.

The final step (7) of the process according to the invention is the winning of xylose from the collected solutions. The sugar solution or fraction collected in step (6) may have a concentration of about 6–9% by weight of xylose. It is filtrated to remove insoluble and suspended impurities and then passed through a cation- and an anion-exchange resin to remove cations and anions present in the solution and to decolourize it. It should be noted that acetic acid is hardly bonded by the resins employed. In practice the purified solution is concentrated in a multiple step evaporator followed by a short holding time type evaporator to yield a syrup containing about 70 to 75% by weight of xylose. The acetic acid is removed with the water vapour. After condensation of the vapours the acid condensate may be used for the purification of the residues of annuals in step (1) of the process.

From the concentrated xylose syrup obtained after the evaporation of water from the first fraction pure xylose may be obtained by crystallization and separation of the crystals from the mother liquor in a usual way. The mother liquor is concentrated again and a second portion of xylose can be crystallized from this solution. The second mother liquor may be hydrogenated and used as crude polyalcohols for technical purposes.

It should be noted that xylose does not crystallize efficiently from the concentrated syrup if salts and organic substances are not removed from the residues of annuals used as the raw material. Then the impurities have to be removed from the xylose solution which is a more cumbersome operation than the removal of salts and other impurities from the residues of annuals. So the efficiency of step (1) is decisive for the final result of step (7).

An other embodiment of the invention comprises the use of the pure xylose solution obtained in step (7) without crystallization. This pure solution may be hydrogenated to yield a syrup of xylitol which is very useful as a sweetener for industrial purposes such as in the production of jams etc. Since the xylose solution obtained in step (7) is very pure it is possible to produce xylitol solutions without the intermediate step of crystallization of the xylose.

Generally, the xylose obtained from the concentrated syrup by crystallization is sufficiently pure for commercial purposes and need not be recrystallized. It may be used for the production of xylitol by hydrogenation in a known manner. Thus the process according to the invention enables the production in an economical way of a relatively pure xylose syrup from which pure xylose will crystallize easily.

Example (with Brief Description of the Drawing)

(The numbers in this example refer to the accompanying drawing which shows a flow scheme of the process).

Straw having a moisture content of 17.3% by weight and a pentosan content of 20.9% by weight was chopped and purified in a known manner and then fed at 1 to a continuously operated extractor E1 of the type described in Dutch Patent No. 85276 at a rate of 1000 kg/h.

Countercurrently to the straw a sulfuric acid solution obtained from 99 kg of acetic acid containing water of condensation and 1 kg of sulfuric acid (96%) at a temperature of 70° C. was fed at 2 to the extractor E1 at a rate of 4248 kg/h. The average residence time of the straw in the extractor E1 was 40 minutes. At 3 3797 kg/h of waste water were drawn from the extractor. With this waste water 94% of the salts present in the straw were removed. The pH of the waste water was 1.7.

The value of $f_1$ in the equation (I) for this extraction was 3.1.

4209 kg/h of extracted wet straw having a solids content of 18.5% by weight and a pentosan content of 4.7% by weight were removed from the extractor E1 at 4 and fed to a roller press P1. From this press 2363 kg/h of press-water were drawn off at 5. This press-water was added to the sulfuric acid feed 2.

1846 kg/h of pressed straw having a moisture content of 40.7% by weight and a pentosan content of 10.7% by weight were removed from the roller press P1 at 6 and fed to the top of one of the reactors R1, R2 and R3. The aqueous phase in the pressed straw contained 0.9% by weight of $H_2SO_4$, calculated on the aqueous phase. Each of the reactors R1, R2 and R3 had a capacity of 16 $m^3$. The reactors were situated so as to have available always one of the three reactors for filling with straw, the other two reactors being available for the hydrolysis and for emptying. Filling of a reactor took 120 minutes. After being filled with pressed straw the reactor was closed and then filled at 7 in upward direction with an acid hydrolysis solution containing 2.5% by weight of pentoses and 1.0% by weight of $H_2SO_4$. From the top of the reactor at 8 were first drawn off 3282 kg of liquid containing 1.8% by weight of pentoses and 0.71% by weight of $H_2SO_4$. This relatively clean solution was fed to an extractor E2 at a place where the composition of the wash-water streaming through the extractor E2 was approximately the same as that of the first portion of liquid from 8. Then feeding of acid solution at 7 was continued until the temperature at the top of the reactor was 120° C. Subsequently, the free liquid remaining in the reactor was drawn off through the same conduct 7 and recycled to a storage tank T. The acid solution fed to the reactor at 7 originated from tank T and was heated in a heat-exchanger H to bring the straw in the reactor at the desired hydrolysis temperature. After drawing off the free liquid from the reactor the moisture content of the acidified straw in the reactor was 78.5% by weight.

For hydrolyzing the pentosans the straw was kept in the reactor for 120 minutes. As a result of a good heat insulation of the reactor the decrease in temperature during this period was less than 1° C. In this hydrolysis step the value of $f_2$ in the equation (II) was 5.9.

After the hydrolysis period the pressure was released from the reactor and the reactor was emptied through 9. Via an intermediate storage bunker (not shown in the drawing) the contents of the reactor were continuously fed to an extractor E2 at a rate of 3483 kg/h. The wet mass fed to the extractor E2 contained 6.5% by weight of free pentoses and 78.5 by weight of moisture.

Pure wash-water was fed at 10 countercurrently to the fibrous mass in the extractor E2 at a rate of 1814 kg/h. The residence time of the fibrous mass in the extractor E2 was 60 minutes.

From the extractor E2 three product streams were drawn off. A first stream of crude xylose solution was drawn off at 11 at a rate of 2188 kg/h. This crude xylose solution containing 7.7% by weight of xylose was decolourized, demineralized, concentrated by evaporation and crystallized in a usual manner. The yield of pure crystallized xylose was 87.6 kg/h or 52% of the theoretical yield, which is in good agreement with the yield normally obtained in the crystallization of xylose from xylose syrup. At a place of the extractor E2 where the liquid streaming through the reactor contained 2.5% by weight of pentoses a second stream of liquid 12 was drawn off at a rate of 3278 kg/h. This liquid was fed to the storage tank T and later on it was passed through the heat exchanger H and used as liquid for the hydrolysis in the reactors R1, R2 and R3. A third stream 13 consisting of a fibrous mass having a moisture content of 83% by weight was drawn off at the end of the extractor E2. This fibrous mass was fed to a roller press P2 from which a pressed fibrous mass having a moisture content of 64% by weight was removed at 14 at a rate of 1472 kg/h. This fibrous mass was used for paper-making. A press-liquid 15 was drawn from the roller press P2 at a rate of 1744 kg/h. This press-liquid contained 0.1% by weight of $H_2SO_4$ and 0.7% by weight of pentoses. It was fed to the extractor E2 at a place where the composition of the wash-liquid in the extractor E2 was approximately the same as that of the press-liquid.

We claim:

1. A process for the winning of xylose by the hydrolysis of residues of annuals comprising removing salts and undesired organic substances from said residues with an aqueous acid solution at an elevated temperature, acidifying said residues with an aqueous acid solution, hydrolyzing same at an elevated temperature, separating the hydrolysate from said residues, and crystallizing xylose from said hydrolysate, said process comprising (1) solubilizing, dissolving, and extracting salts and undesired organic substances from the residues of annuals by contacting same countercurrently with an aqueous acid solution at an elevated temperature during such a time that $$^{10}\log t_1 = pH_1 - (T_1/25) + f_1 \quad \text{(I)}$$

wherein $t_1$ is the acting time of the acid solution in minutes, $pH_1$ is the value of the pH of the aqueous acid solution used for this treatment of the residues of annuals, which value should range from 1 to 5, $T_1$ is the holding temperature of the mixture of residues of annuals and acid solution in °C., $f_1$ is a number having a value of from 2.5 to 4.0 dependent on the type and nature of the residues of annuals used and on the mechanical treatment during this step, as well as on the particle size of the residues of annuals used;

(2) pressing the treated residues;

(3) moistening the pressed residues to a moisture content of at least 75% by weight of the moist residues with an acid solution which contains xylose and which does not contain $SO_2$ either (a) when the hydrolysis is carried out continuously by simultaneously feeding the acid solution and the pressed residues to the hydrolysis reactor, or (b) when the hydrolysis is carried out discontinuously in a vertical column by slowly introducing the acid solution at the bottom of the column;

(4) hydrolyzing the pentosans present in the acidified residues either (a) in a continuously operated apparatus by blowing steam into the acidified residues, or (b) in a discontinuously operated apparatus by heating the acid solution of step (3*b*), and maintaining the conditions during such a time that $$^{10}\log t_2 = pH_2 - (T_2/25) + f_2 \quad \text{(II)}$$

wherein $t_2$ is the hydrolysis time in minutes, $pH_2$ is the value of the pH of the liquid present in the mixture of residues and acid solution, which value should be lower than 3.0, $T_2$ is the holding temperature of said mixture in °C., which should be higher than 100° C., $f_2$ is a number having a value of from 5.4 to 6.2;

(5) terminating the hydrolysis by decreasing the temperature either by quenching or by releasing the pressure from the reactor;

(6) extracting the pentoses from the residues with water either (a) continuously and countercurrently, or (b) discontinuously in a column in a downward flow;

(7) filtering the xylose solution obtained, decolourizing and purifying it with a cation- and anion- exchange resin, concentrating it by evaporation, and, if desired, winning xylose from the xylose syrup obtained by crystallization and isolation of the crystalline mass.

2. The process of claim 1 wherein the acid washing solution in step (1) contains mineral acids, and/or aliphatic carboxylic acids having 1 to 3 carbon atoms in the hydrocarbon chain, and/or aliphatic hydroxycarboxylic acids having 1 to 3 carbon atoms in the hydrocarbon chain.

3. The process of claim 1 or 2 wherein the acid extracting solution in step (1) contains acetic acid.

4. The process of claim 1 wherein the extracting solution in step (1) has a temperature of from 50° to 100° C., preferably of from 60° to 80° C.

5. The process of claim 1 wherein the acid solution used in step (3) contains hydrochloric, sulfuric, nitric, phosphoric, tartric, citric and/or gluconic acid and/or acids obtained from step (2) and/or step (6).

6. The process of claim 1 wherein the acid solution used in step (3) contains 0.1 to 0.4% by weight of hydrogen chloride, based on the weight of the solution, and has a temperature of from 50° to 100° C.

7. The process of claim 1 wherein the acid solution used used in step (3) contains 0.25 to 1.0 by weight of sulfuric acid, based on the weight of the solution, and has a temperature of from 50° to 100° C.

8. The process of claim 1 wherein the acid solution in step (3) contains 2 to 3% by weight of pentoses, based on the weight of the solution.

9. The process of claim 1 wherein the extraction in step (1) is carried out by transporting the residues of annuals through a screw extractor and feeding the acid solution to the screw extractor countercurrently to said residues.

10. The process of claim 1 wherein in step (2) the extracted residues obtained from step (1) are freed from acid solution in a roller press.

11. The process of claim 1 wherein the residues of annuals are straw.

* * * * *